US009090383B2

(12) United States Patent
Forman et al.

(10) Patent No.: US 9,090,383 B2
(45) Date of Patent: Jul. 28, 2015

(54) TAPE SEALED RECLOSABLE BAG

(75) Inventors: Harold M. Forman, Gilbertsville, PA (US); Jo Anne Forman, Gilbertsville, PA (US); Lisa Ann Oberholtzer, East Greenville, PA (US); Harry J. Cappa, Jr., Reading, PA (US)

(73) Assignee: Sealstrip Corporation, Gilbertsville, PA (US)

( * ) Notice: Subject to any disclaimer, the term of this patent is extended or adjusted under 35 U.S.C. 154(b) by 238 days.

(21) Appl. No.: 13/308,868

(22) Filed: Dec. 1, 2011

(65) Prior Publication Data

US 2013/0142455 A1 Jun. 6, 2013

(51) Int. Cl.
*B65D 33/00* (2006.01)
*B65D 33/18* (2006.01)

(52) U.S. Cl.
CPC ..... *B65D 33/18* (2013.01)

(58) Field of Classification Search
CPC ..... B65D 75/58; B65D 75/5838; B65D 75/5894; B65D 75/5827; B65D 75/5833; B65D 75/5855; B65D 75/66; B65D 33/34
USPC ..... 383/42, 66, 200, 203–205, 207–211, 383/78, 81
See application file for complete search history.

(56) References Cited

U.S. PATENT DOCUMENTS

| | | | |
|---|---|---|---|
| 2,480,500 | A | 8/1949 | Moore |
| 2,949,370 | A | 8/1960 | Hughes |
| 3,098,601 | A | 7/1963 | Anderson et al. |
| 3,171,539 | A | 3/1965 | Holbrook et al. |
| 3,613,874 | A | 10/1971 | Miller |
| 3,626,143 | A | 12/1971 | Fry |
| 3,981,230 | A | 9/1976 | Lee |
| 4,092,518 | A | 5/1978 | Merard |
| 4,216,254 | A | 8/1980 | Lundell et al. |
| 4,335,817 | A | 6/1982 | Bahr |
| 4,490,203 | A | 12/1984 | Bose |
| 4,586,312 | A | 5/1986 | Limousin |
| 4,709,399 | A | 11/1987 | Sanders |
| 4,762,514 | A | 8/1988 | Yoshida |
| 4,840,270 | A | 6/1989 | Caputo et al. |
| 4,851,061 | A | 7/1989 | Sorkoram |
| 4,854,999 | A | 8/1989 | Schirmer |

(Continued)

FOREIGN PATENT DOCUMENTS

| | | | |
|---|---|---|---|
| GB | 2193484 | A | 2/1988 |
| GB | 2265883 | A | 10/1993 |
| JP | 05221454 | A | 8/1993 |

*Primary Examiner* — Jes F Pascua
*Assistant Examiner* — Nina Attel
(74) *Attorney, Agent, or Firm* — Ryder, Lu, Mazzeo & Konieczny, L.L.C.; Gregory J. Gore, Esq.; Joseph M. Konieczny, Esq.

(57) ABSTRACT

In the manufacturing process for producing a package, a resealing tape strip is formed and applied to packaging film before any slits or cuts are made. A package opening slit is then cut into the packaging film from the opposite side of the film in the area of the tape strip but short of cutting into it. The tape strip has an adhesive layer coextensive with one side of the tape while adhesive deadening material is selectively printed in areas on the tape film web to produce a differential adhesive quality of the tape. The shape of the tape may be provided with a curved edge to enhance its function or for aesthetic reasons. The opening slit is preferably cut with a laser and may be cut into different shapes to affect the opening characteristics of the package.

18 Claims, 9 Drawing Sheets

(56) References Cited

U.S. PATENT DOCUMENTS

| | | | | | |
|---|---|---|---|---|---|
| 4,889,234 | A | | 12/1989 | Sorensen et al. | |
| 4,902,141 | A | | 2/1990 | Linnewiel | |
| 4,902,142 | A | * | 2/1990 | Lammert et al. | 383/78 |
| 4,931,134 | A | | 6/1990 | Hatkevitz et al. | |
| 5,007,744 | A | | 4/1991 | Scarberry et al. | |
| 5,061,535 | A | | 10/1991 | Kreckel et al. | |
| 5,167,455 | A | * | 12/1992 | Forman | 383/66 |
| 5,172,854 | A | | 12/1992 | Epstein et al. | |
| 5,174,658 | A | | 12/1992 | Cook et al. | |
| 5,229,180 | A | | 7/1993 | Littmann | |
| 5,318,818 | A | | 6/1994 | Sjoestroem | |
| 5,407,278 | A | | 4/1995 | Beer | |
| 5,407,611 | A | | 4/1995 | Wilhoit et al. | |
| 5,421,933 | A | | 6/1995 | Nedblake et al. | |
| 5,430,987 | A | | 7/1995 | Lane, Jr. et al. | |
| 5,456,928 | A | | 10/1995 | Hustad et al. | |
| 5,459,978 | A | | 10/1995 | Weiss et al. | |
| 5,474,637 | A | | 12/1995 | Soodak | |
| 5,520,760 | A | | 5/1996 | Freedman | |
| 5,520,764 | A | | 5/1996 | Toney et al. | |
| 5,564,259 | A | | 10/1996 | Stolmeier | |
| 5,591,290 | A | | 1/1997 | Walter et al. | |
| 5,607,606 | A | | 3/1997 | Mori et al. | |
| 5,611,949 | A | | 3/1997 | Snellman et al. | |
| 5,630,308 | A | | 5/1997 | Guckenberger | |
| 5,679,199 | A | | 10/1997 | Nedblake et al. | |
| 5,713,824 | A | | 2/1998 | Drummond et al. | |
| 5,725,311 | A | | 3/1998 | Ponsi et al. | |
| 5,779,832 | A | | 7/1998 | Kocher | |
| 5,810,599 | A | | 9/1998 | Bishop | |
| 5,820,953 | A | | 10/1998 | Beer et al. | |
| 5,829,884 | A | | 11/1998 | Yeager | |
| 5,874,155 | A | | 2/1999 | Gehrke et al. | |
| 5,878,971 | A | | 3/1999 | Minnema | |
| 5,914,165 | A | | 6/1999 | Freedman | |
| 5,938,013 | A | | 8/1999 | Palumbo et al. | |
| 5,945,145 | A | | 8/1999 | Narsutis et al. | |
| 5,982,284 | A | * | 11/1999 | Baldwin et al. | 340/572.8 |
| 5,983,594 | A | | 11/1999 | Forman | |
| 6,024,830 | A | | 2/2000 | Nedblake et al. | |
| 6,026,953 | A | | 2/2000 | Nakamura et al. | |
| 6,062,470 | A | | 5/2000 | Robichaud | |
| 6,103,050 | A | | 8/2000 | Krueger | |
| 6,113,271 | A | | 9/2000 | Scott et al. | |
| 6,244,746 | B1 | | 6/2001 | Tokita et al. | |
| 6,254,519 | B1 | | 7/2001 | Toshima | |
| 6,259,058 | B1 | | 7/2001 | Hoekstra | |
| 6,309,745 | B1 | | 10/2001 | Willms et al. | |
| 6,328,203 | B1 | | 12/2001 | Tedford, Jr. | |
| 6,350,340 | B1 | | 2/2002 | Johnson | |
| 6,364,990 | B1 | * | 4/2002 | Grosskopf et al. | 156/268 |
| 6,461,044 | B1 | | 10/2002 | Anderson | |
| 6,488,228 | B2 | | 12/2002 | Davies et al. | |
| 6,511,725 | B1 | | 1/2003 | Rawlings | |
| 6,517,243 | B2 | | 2/2003 | Huffer et al. | |
| 6,592,693 | B1 | | 7/2003 | Nedblake | |
| 6,596,361 | B2 | | 7/2003 | Klein et al. | |
| 6,624,413 | B1 | | 9/2003 | Klein | |
| D482,614 | S | | 11/2003 | Countee, Jr. | |
| 6,660,963 | B2 | | 12/2003 | Hoekstra et al. | |
| 6,695,501 | B2 | | 2/2004 | Nedblake, Jr. et al. | |
| 6,719,678 | B1 | | 4/2004 | Stern | |
| 6,723,952 | B2 | | 4/2004 | Choo et al. | |
| 6,749,877 | B2 | | 6/2004 | Hodson et al. | |
| 6,769,227 | B2 | | 8/2004 | Mumpower et al. | |
| 6,863,646 | B2 | | 3/2005 | Kinigakis et al. | |
| 6,865,860 | B2 | | 3/2005 | Arakawa et al. | |
| 6,918,532 | B2 | | 7/2005 | Sierra-Gomez et al. | |
| 6,924,829 | B2 | | 8/2005 | Kusano | |
| 6,974,256 | B2 | | 12/2005 | Kinigakis et al. | |
| 7,056,593 | B2 | | 6/2006 | Kennedy et al. | |
| 7,122,235 | B2 | | 10/2006 | Bourdelais et al. | |
| 7,250,210 | B2 | | 7/2007 | Mazurek et al. | |
| 7,254,873 | B2 | | 8/2007 | Stolmeier et al. | |
| 7,304,265 | B2 | | 12/2007 | Otsu et al. | |
| 7,306,370 | B2 | | 12/2007 | Howell et al. | |
| 7,331,159 | B2 | | 2/2008 | Osgood | |
| 7,371,008 | B2 | | 5/2008 | Bonenfant | |
| 7,410,298 | B2 | | 8/2008 | Pawloski | |
| 7,592,057 | B2 | | 9/2009 | Dronzek, Jr. et al. | |
| 7,651,290 | B2 | | 1/2010 | Bauer et al. | |
| 7,673,909 | B2 | | 3/2010 | Rousselet | |
| 7,717,620 | B2 | | 5/2010 | Hebert et al. | |
| 7,744,517 | B2 | | 6/2010 | Bonenfant | |
| 7,789,236 | B2 | | 9/2010 | Burgess | |
| 2001/0037627 | A1 | | 11/2001 | Hausslein | |
| 2002/0068668 | A1 | | 6/2002 | Chow et al. | |
| 2005/0053315 | A1 | | 3/2005 | Aasen | |
| 2006/0219072 | A1 | | 10/2006 | Tynkkynen et al. | |
| 2006/0251341 | A1 | | 11/2006 | Sampaio Camacho | |
| 2006/0283727 | A1 | | 12/2006 | Nelson et al. | |
| 2007/0020423 | A1 | * | 1/2007 | Chamandy et al. | 428/40.1 |
| 2007/0270310 | A1 | | 11/2007 | Blank et al. | |
| 2008/0063321 | A1 | | 3/2008 | Hodson et al. | |
| 2009/0152139 | A1 | * | 6/2009 | Roesink et al. | 206/260 |
| 2010/0111453 | A1 | * | 5/2010 | Dierl | 383/204 |
| 2013/0121623 | A1 | * | 5/2013 | Lyzenga et al. | 383/203 |

* cited by examiner

FIG.5
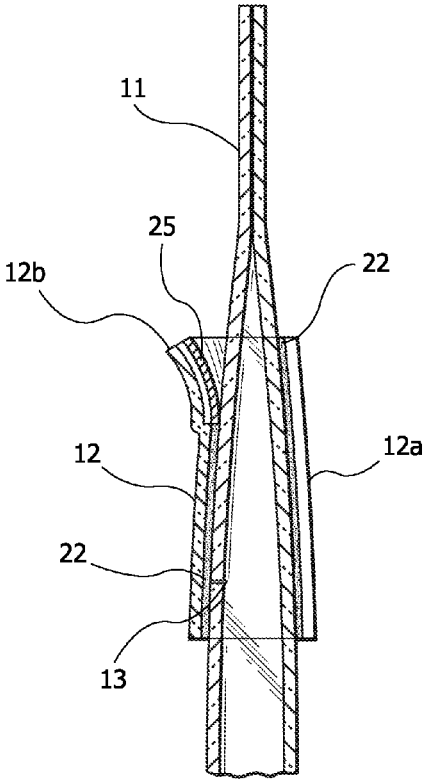
FIG.6
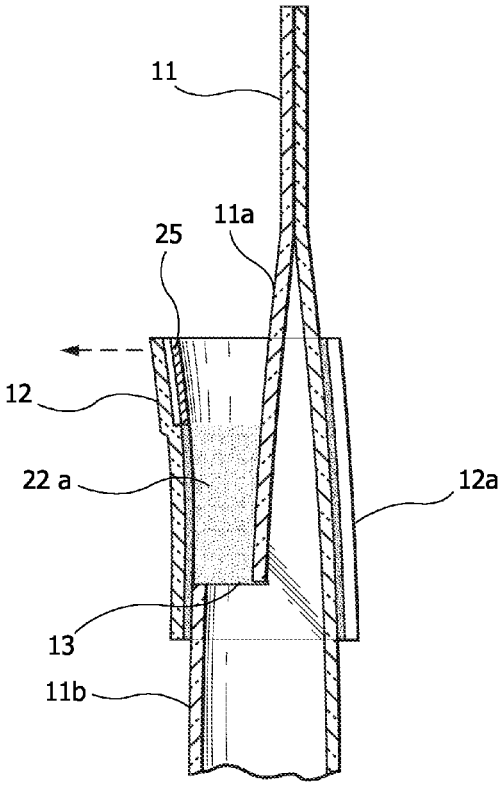
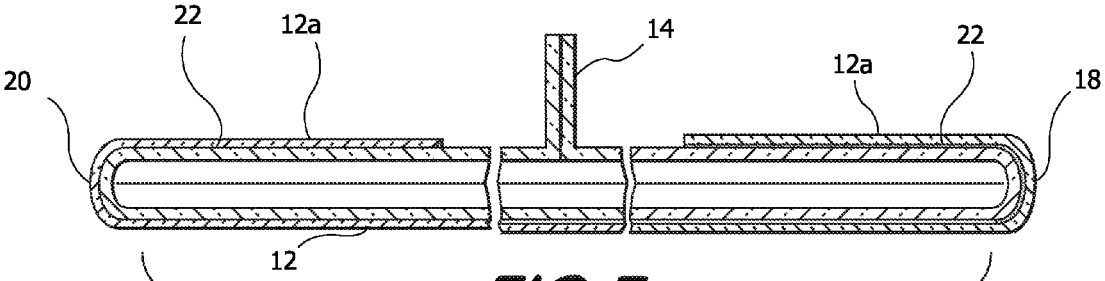
FIG.7

FIG.10
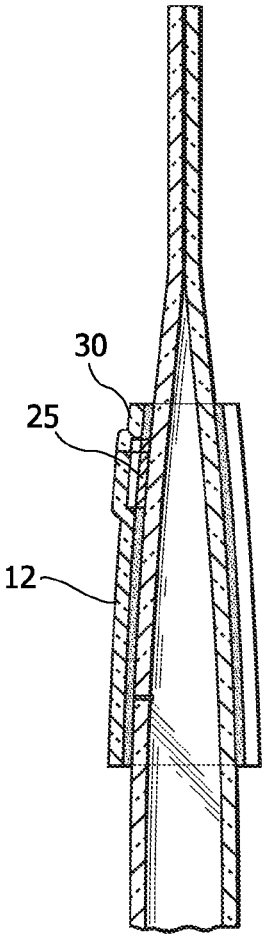
FIG.11
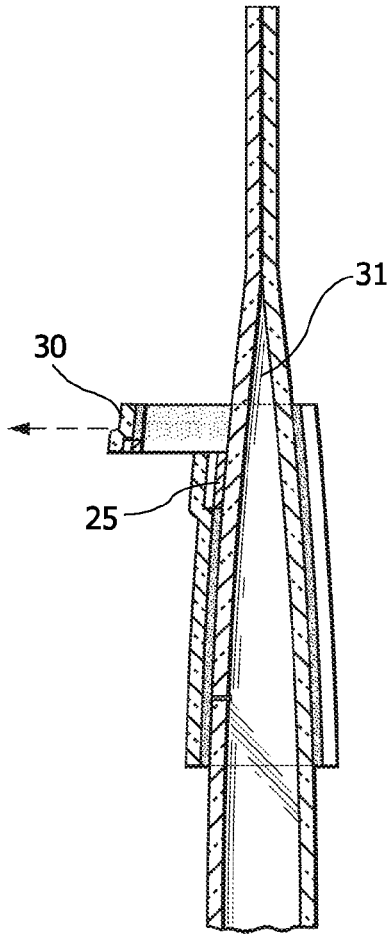
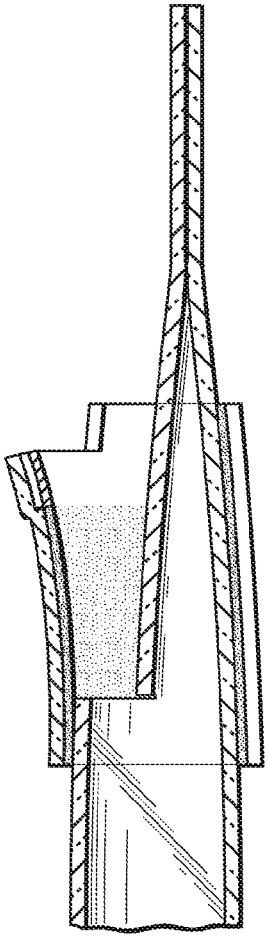
FIG.12

FIG.15
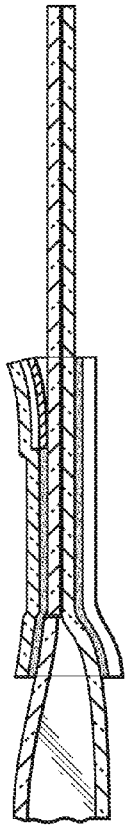
FIG.16
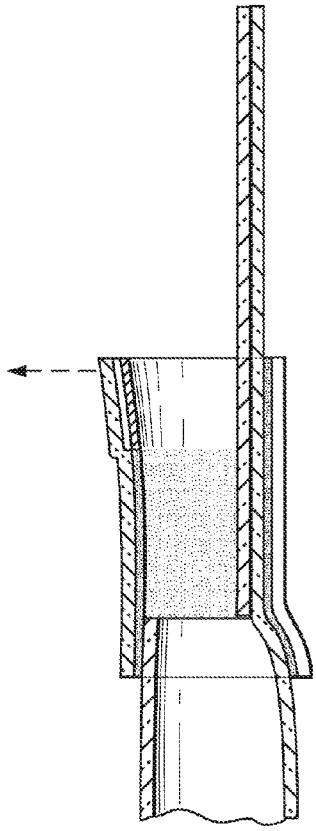
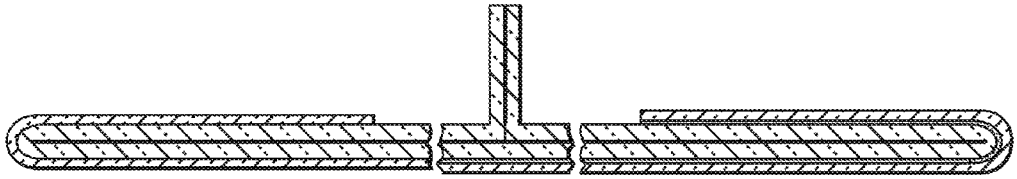
FIG.17

TAPE SEALED RECLOSABLE BAG

FIELD OF THE INVENTION

The present invention relates to pillow-type plastic bags and packaging systems adhesively reclosable. More specifically, it relates to the use of laser cutting of rolls of flexible packaging film and adhesively taping over the opening with a horizontal sealing strip that is vertically peelable.

BACKGROUND OF THE INVENTION

It is known in the art to form a package with composite packaging film where the film is first transversely slotted at package length intervals and then applying a strip from a roll of adhesively coated film pressed onto it covering over the previously cut slot. The composite film is then fed into a packaging machine or wound onto a take-up roll for future use. Such technology is described for example in U.S. Pat. No. 5,983,594 entitled "Adhesively Peelable Package Method and Apparatus" issued to Harold J. Forman. In that system, adhesive tape secures the bag in a closed position by adhering the front of the bag to the inside rear wall of the bag by contact with the sealing tape through the slot.

U.S. Pat. No. 6,254,519 issued to Isao Toshima entitled "Tape Sealed Bag and Method for Producing the Same" discloses flexible packaging wherein a preformed slit in the supply film is first covered by placing a fusing tape over the slit. A weld is then placed around the perimeter of the slit to obtain a positive seal to the bag. The slit is positioned below the top edge of the bag which is then heat sealed to form the top end wall of the bag. Additional welds are placed at the rear of the bag on wraparound ends of the fusing tape. The high yield strength of the weld provides the positive package sealing while a low yield strength adhesive of the tape provides easy opening and reclosing after the welds are burst on the initial package opening. The burst welds serve to indicate that the package has been previously opened.

U.S. Pat. No. 4,709,399 issued to Sanders entitled "Opening Facilitating Closure Tape and Container" discloses a peel-down tape which covers a lateral package opening slit. This document discloses the use of corona discharge for a means of treating either the tape or the web to affect adhesion.

A problem with the prior art is that forming the slit in the web prior to applying the opening tape weakens the film strength and reduces the allowable amount of feed tension below that which is necessary for rapid production. Also, because the opening is below the top of the bag, contents of the bag accumulate in the pocket between the top of the opening and the top of the bag and interfere with reclosing.

There is therefore a need in the art to overcome the above-described disadvantages of the prior art packaging and to provide an easy-open resealable package which may be rapidly produced by permitting a higher speed production rate.

SUMMARY OF THE INVENTION

In order to meet the needs in the art the present invention has been devised. In the present invention, a resealing strip (i.e. a tape) is formed and applied to intact packaging film before any slits or cuts are made in the packaging film. A slit is then cut into the packaging film from the opposite side in the area of the tape strip but without cutting the resealing strip. Forming the resealing strip and applying it to the film before the film is slit prevents tearing or weakening of the packaging film encountered in the prior art and allows production of an easy-open resealable package at higher speeds and with less complicated web control mechanisms.

The structure of the opening tape strip segment as it is adhered to the package is structurally significant. As further described herein, the tape has an adhesive layer coextensive with one side of the tape web while adhesive deadening material is selectively printed in areas on the tape film web to produce differential adhesion qualities of the tape. This permits easy opening yet secure attachment of the tape to a degree not yet achieved by the prior art. Furthermore, the shape of the tape may be provided with a curved edge to enhance its function or for aesthetic reasons. Similarly, the slit may be cut in to different shapes to affect the opening characteristics of the package. These structural features are not known to the prior art.

More specifically, tape film coated with adhesive on one side is unwound from a supply roll and fed onto a tape drum with the adhesive side facing outward, where a computer controlled laser cuts the tape film into a resealing strip of the desired shape. Deadening material is selectively applied to the resealing strip to create an area that is fully deadened (a dry portion), an area that is partially deadened (a resealing portion) and an area that is undeadened (a fully adhesive permanent attachment portion) and is advanced to a nip roller. Intact packaging film is unwound from a supply roll through a system of tension-supplying rollers to the nip roller where the resealing strip is rolled onto the packaging film and pressed onto it. Additional resealing strips are cut and applied to the packaging film at the desired intervals. The packaging film with resealing strips now adhered to it form a composite web that is fed through a series of rollers to maintain optimal tension to a film drum, where a computer controlled timing apparatus causes a second laser to cut a slit of the desired shape and length in the film under the resealing strip by a precise focusing of the laser beam while not cutting into the resealing strip. Maintaining the integrity of the resealing strip over the slit in the packaging film prevents the packaging film from weakening, tearing or distorting after the slit is cut, allowing higher tension on the film to be maintained and thereby allowing faster production.

The composite packaging film is fed to the packaging apparatus known in the prior art, where the product is dispensed, the packaging film folded around the product, the film sealed longitudinally forming the back seam of the packages and heat sealed and cut transversely at intervals forming the top and bottom ends of the packages. In one embodiment, the heat sealing of the packaging film is controlled so that the heat seal weld applied to the top end of the finished package extends to the top of the over the tape. In this embodiment, the tape is not affected by the heat seal welding because of the nature of the tape material which leaves the tape unaffected except for a rippling of its surface caused by the jaws of the heat sealer. In an alternate embodiment, the resealing strip is perforated so as to create a tear strip as a tamper-evident feature.

The invention solves the problems of the prior art by applying resealing tapes to the packaging film before forming the slit; by forming the resealing strips and the slit in a manner that enables a high degree of precision and control not achievable in prior art systems and with utilizing less complicated web control mechanisms; by forming and applying the resealing strips in-line during package production and at production speeds without interruption of the feed motion; by eliminating the need for pre-slitted or composite film; by creating a package with a peel material tape which opens the package widthwise from the top down, making it easier and quicker to open than horizontal peel tapes of the prior art. The invention creates a package that is sealed to the top of the package opening slit, thus eliminating the pocket between the top edge and the package opening slit found in prior art packages.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention.

BRIEF DESCRIPTION OF THE DRAWINGS

FIG. 5 is a partial right side cross-sectional view of the top edge of the package of the invention in a closed position showing the fully deadened dry edge of the resealing strip pulled slightly away from the front of the package.

FIG. 6 is a partial right side cross-sectional view of the top edge of the package of the invention shown in FIG. 5 in an open position with the arrow indicating the direction of opening force.

FIG. 7 is a top cross-sectional view of the package in a closed position.

FIG. 10 is a right side cross-sectional view of the alternate embodiment shown in FIG. 8 in an unopened position.

FIG. 11 is a right side cross-sectional view of the alternate embodiment shown in FIG. 8 being unsealed with the arrow indicating the direction of opening force.

FIG. 12 is a right side cross-sectional view of the alternate embodiment shown in FIG. 8 in an unsealed and open position.

FIG. 15 is a partial right side cross-sectional view of the top edge of the alternate embodiment shown in FIG. 13 in a closed position showing the fully deadened dry edge of the resealing strip pulled slightly away from the front of the package.

FIG. 16 is a partial right side cross-sectional view of the top edge of the alternate embodiment shown in FIG. 13 in an open position with the arrow indicating the direction of opening force.

FIG. 17 is a top cross-sectional view of the alternate embodiment shown in FIG. 13 in a closed position.

DESCRIPTION OF THE PREFERRED EMBODIMENT

Figure 1:
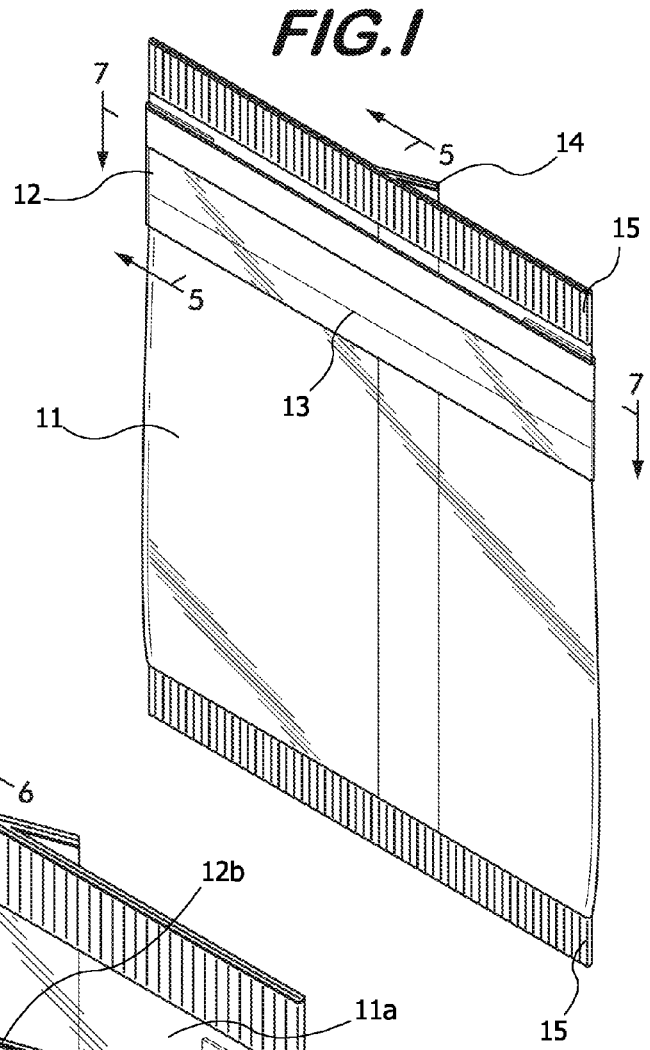
FIG. 1 is a right front isometric view of the package of the invention.

Referring now to FIG. 1, the completed package of the invention is shown. This embodiment and the others that follow are constructed of transparent materials so that the package contents can be seen. The basic structure of the packaging includes front panel 11 having a contents opening slit 13 that is covered by a reclosable tape segment 12. The tape 12 completely spans the front panel 11 laterally and wraps around side edges of the package to adhere to the rear panel. Front and rear panels are formed by folding plastic packaging film into a tube with lateral edges of the film heat welded along a longitudinal seam 14 at the rear of the package as well known in the art. Heat seal weld 15 at the top and bottom of the package complete its construction.

Figure 2:
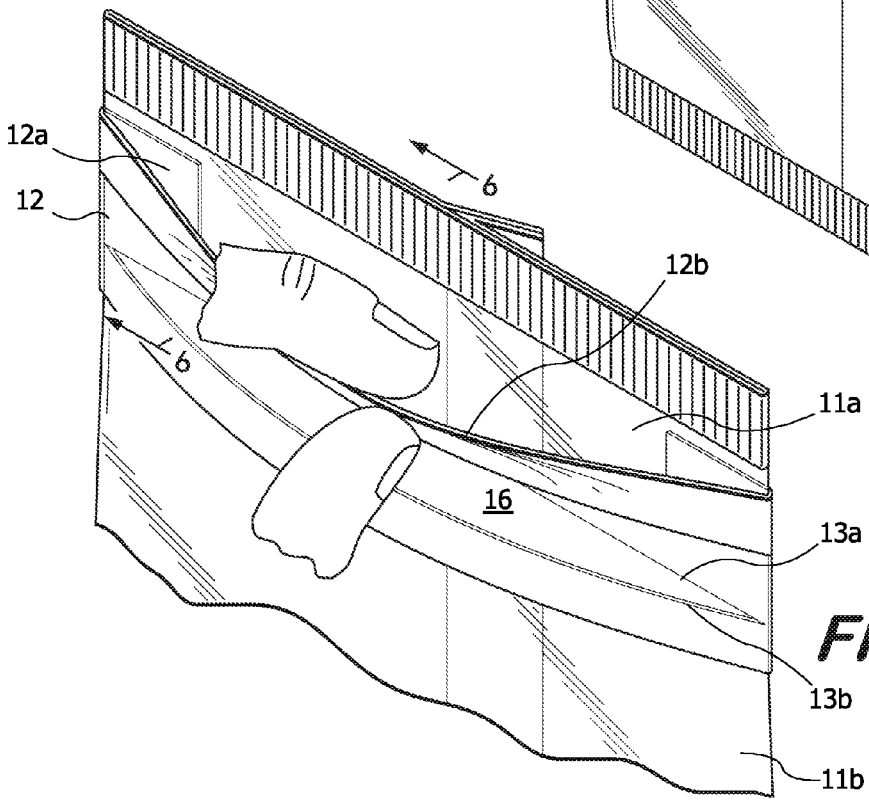
FIG. 2 is an enlarged partial right front isometric view of the top edge of the package of the invention in use showing the package being opened.

Referring now to FIG. 2, the package of FIG. 1 is shown being opened by manually grasping the top edge 12*b* of the tape 12 and pulling it forward away from panel 11. A slit 13 is defined by upper edge 13*a* and lower edge 13*b* and divides the front panel into an upper portion 11*a* and a lower portion 11*b*. The separation of the top and bottom edges of the slit provides an opening 16 there between for access to the package contents.

Figure 3:
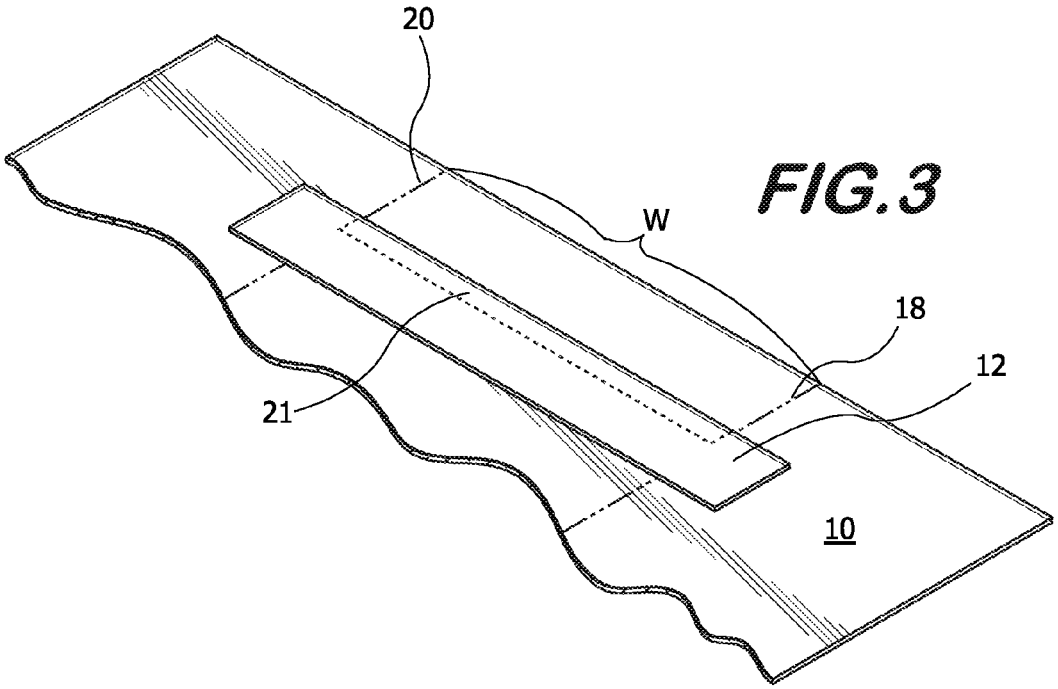
FIG. 3 is a partial top right isometric production view of the composite film web after the resealing strip is applied to the packaging film but before the slit is cut
Figure 4:
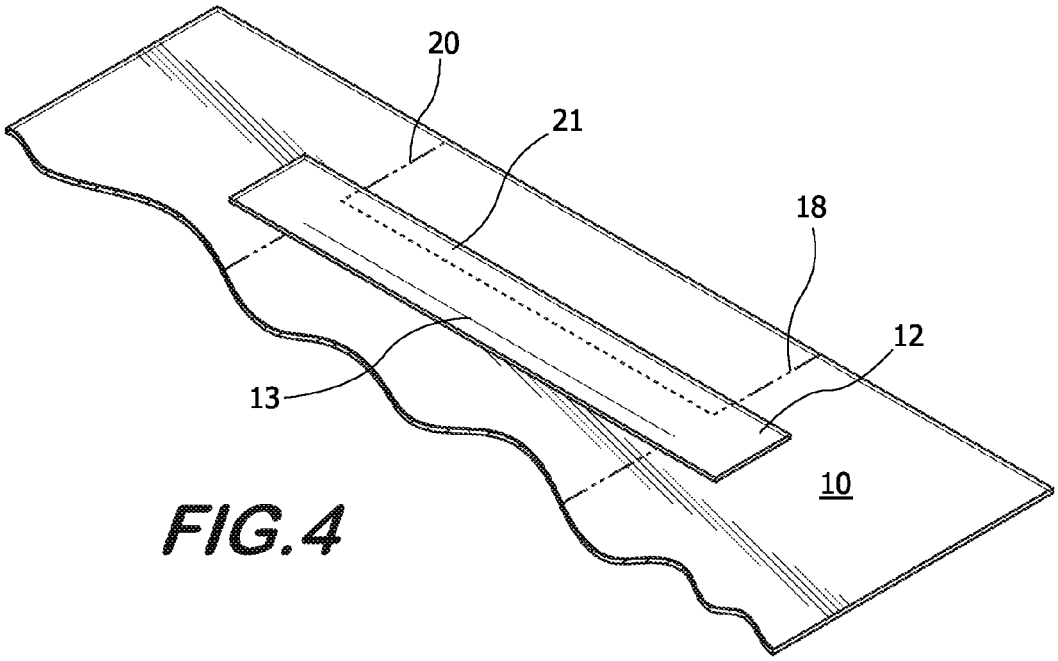
FIG. 4 is a partial top right isometric production view of the composite film web shown in FIG. 3 after the slit is cut.
Figure 8:
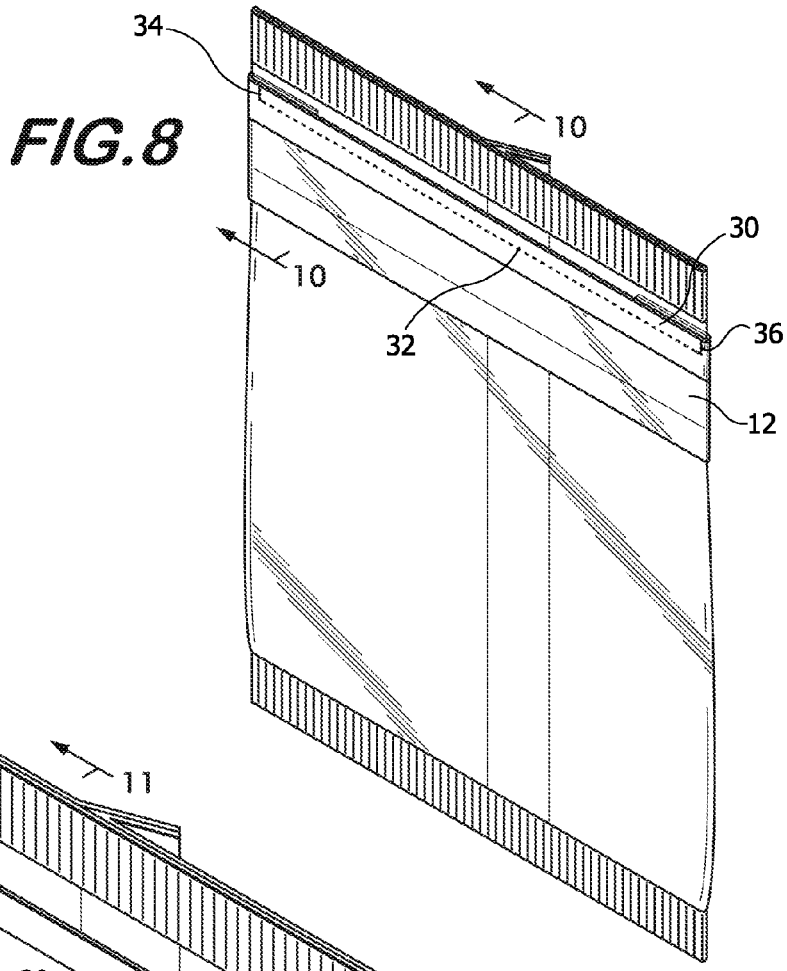
FIG. 8 is a right front isometric view of an alternate embodiment of the package of the invention with a dotted line showing perforation of the resealing strip.

Referring now to FIGS. 3 and 4, the package shown in FIG. 1 is constructed by first applying a tape segment 12 centered on a film web 10. Imaginary fold lines 18 and 20 ultimately form the sides of the package. As seen in FIG. 7, once the packaging is folded at sides 18 and 20, tape 12 will wrap around the sides and firmly adhere to the rear panel of the packaging film by adhesive 22. Seen here in FIG. 7 again, marginal edges of the packaging film are joined along a heat sealed longitudinal seam 14 at the rear of the package. Referring again to FIG. 3, an area 21 parallel to the top edge of tape 12 and extending the full width W of the package includes an adhesive deadening overcoat to reduce the adhesion between the tape 12 and the underlying film 10 providing a "dry" edge for grasping. As seen in FIG. 4, after the tape 12 has been applied a slit 13 is formed in the web material from the opposite side of the web as further described below. The tape bridges the slit and fully surrounds it.

Referring now to FIGS. 5 and 6, the opening sequence of the embodiment shown in FIGS. 1-4 is illustrated. Tape 12 includes an adhesive layer 22 which bridges slit 13 in the front face of packaging film 11. Deadening material 25 is applied to the tape in the area 21 shown in FIGS. 3 and 4 to provide a "dry" grip edge along the top edge 12*b* of the tape to facilitate the manual peeling away of the tape transversely to the length of the slit. In an alternate embodiment (not shown), the deadening of the adhesive in the grip area may also be achieved by a strip of suitable plastic film applied to the adhesive layer. As shown in FIG. 6, when the tape 12 is pulled forward the front panel of the package opens at slit 13 while both sides of tape 12*a* remain fully secured to the rear panel of the package. As will be further described herein, the tape includes areas of selective adhesion 22*a* such that areas of the tape aligned with the front panel of the package above the slit 11*a* more easily separates than the tape adhesion below the slit 11*b* so that the tape adhesion to the lower portion of the front panel 11*b* does not permit the tape to pull away while it separates more easily from the upper portion 11*a*.

Figure 9:
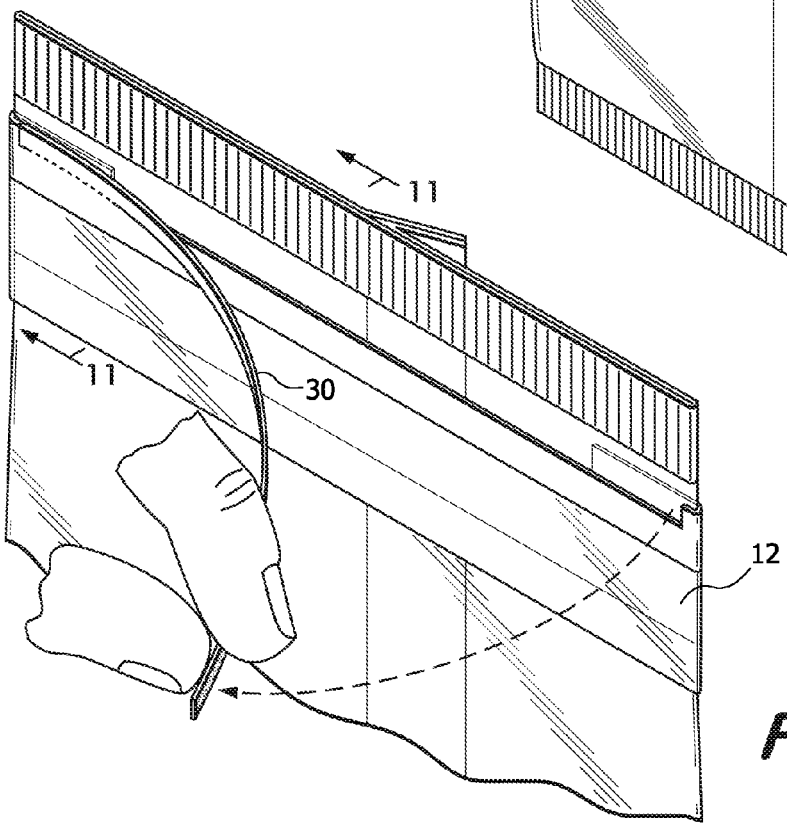
FIG. 9 is an enlarged partial right front isometric view of the top edge of the alternate embodiment shown in FIG. 8 in use/being opened for the first time.
Figure 13:
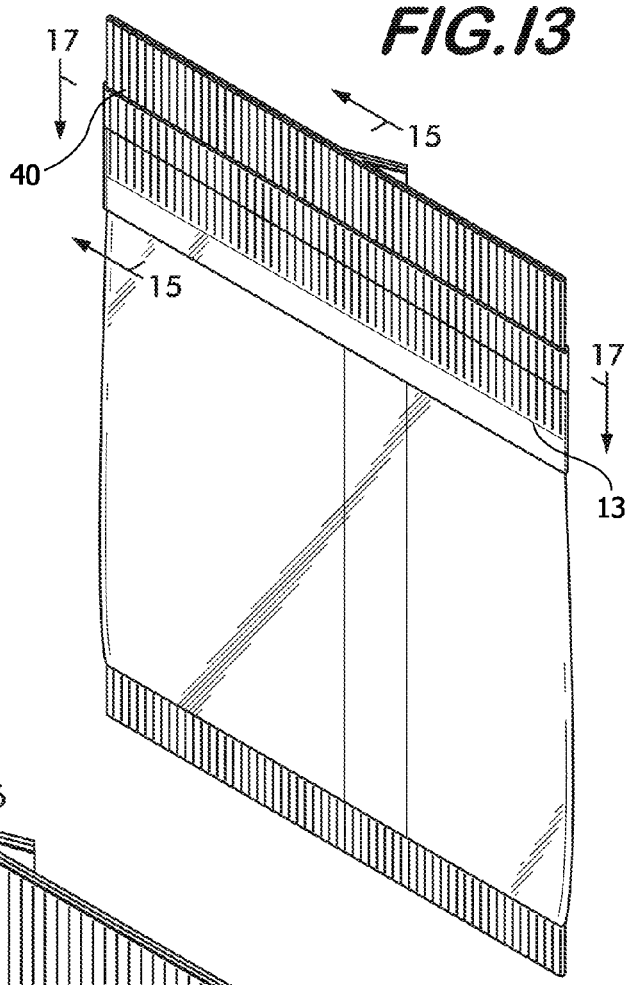
FIG. 13 is a right front isometric view of an alternate embodiment of the invention.
Figure 14:
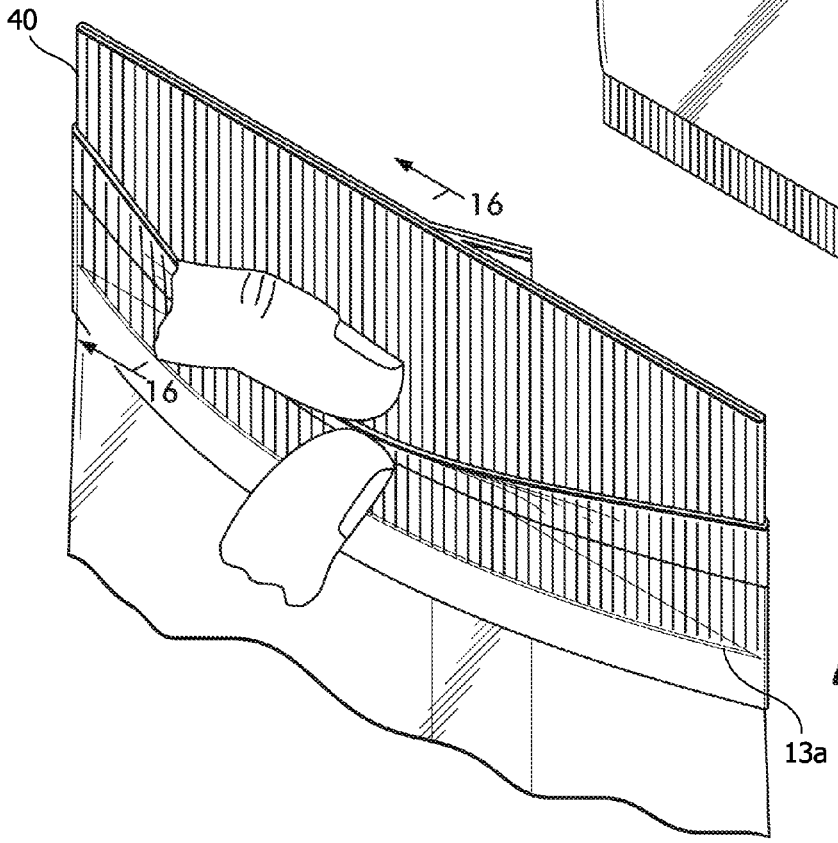
FIG. 14 is a partial right front isometric view of the top edge of the alternate embodiment shown in FIG. 13 being opened/in use.

Referring now to FIGS. 8 through 12, another embodiment of the invention is shown which employs a tear strip along the top edge of the tape to indicate when the package has already been opened. A tear strip shows prior use such as possible tampering. The structure of the packaging and the tape in this embodiment is similar to that shown in the previous FIGS. 1-7 except that a tear-away area 30 located laterally across the top of the tape 12 has been provided. This tear-away area 30 is defined by a line of lateral perforations 32 and opposite facing L-shaped slits 34 and 36 creating the marginal side edges of the tear strip. As shown in FIG. 9, either end of the tear strip 30 may be grasped and torn away from the remaining portion of tape 12 and then discarded.

Figure 19:
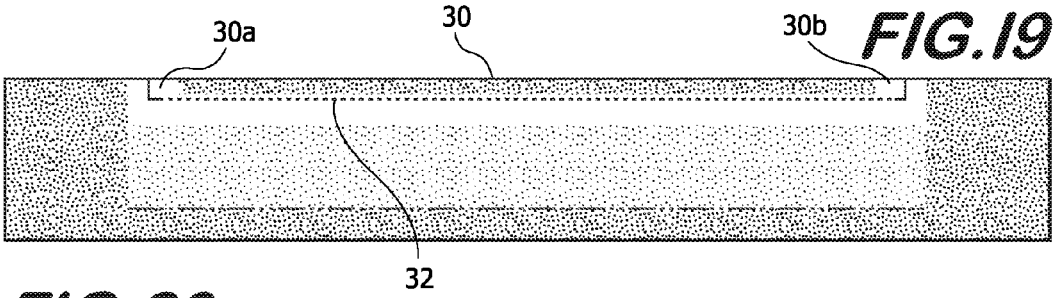
FIGS. 19-23 are front elevation plan views of various resealing strips of the invention with different shapes and patterns of deadening material applied.
Figure 20:
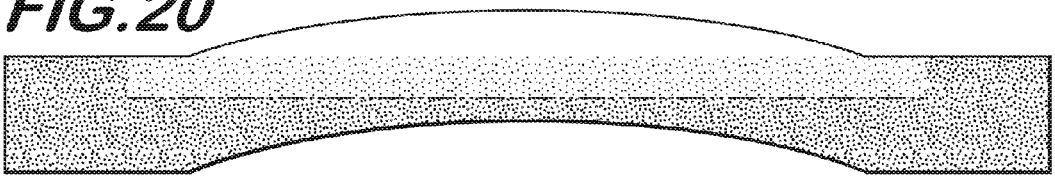
Figure 21:
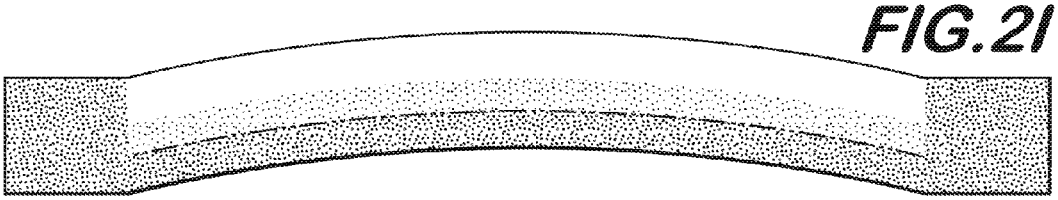
Figure 22:
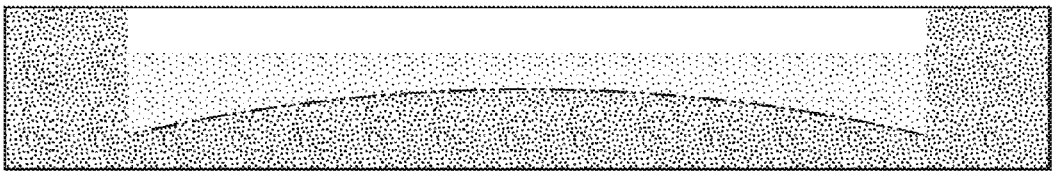
Figure 23:
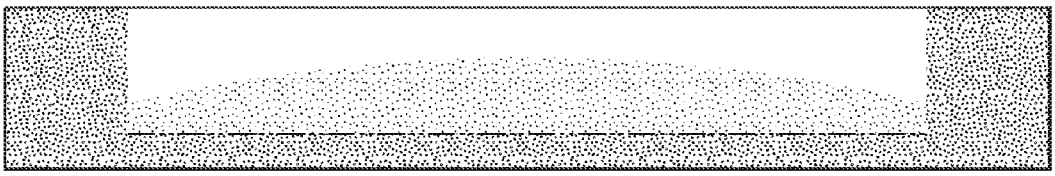
Figure 24:
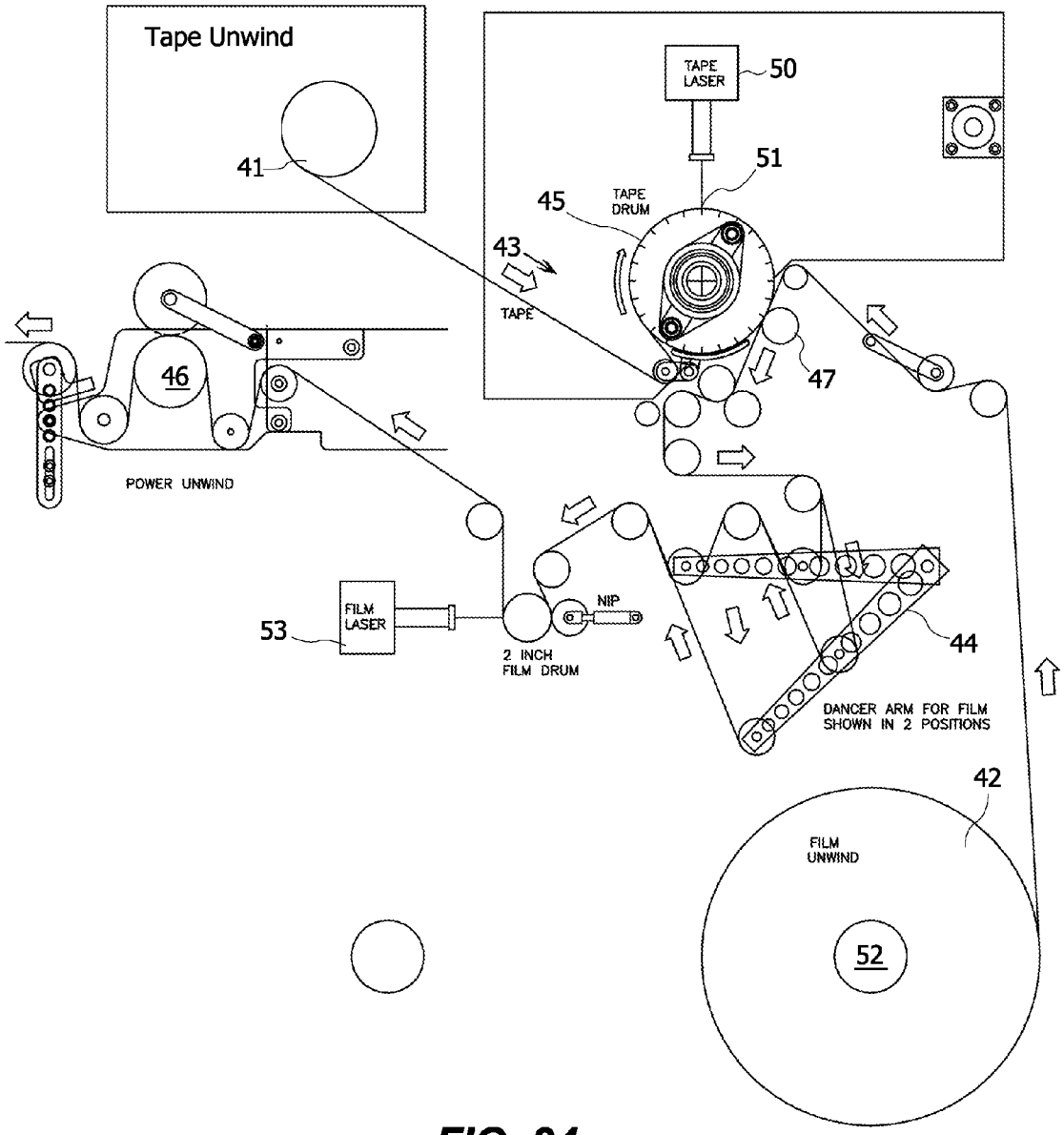
FIG. 24 is a diagram which depicts means for producing the invention.

Referring now to FIGS. 10-12, the opening process utilizing the tear strip embodiment of FIGS. 9 and 10 is shown. The tear strip 30 is a tear away portion of the tape 12 and not a separate structure. This construction provides the advantages of simplicity and economy. It is formed as previously described with regard to FIGS. 8 and 9. Being devoid of deadening material, the area encompassed by the tear strip portion of the tape 30 is endowed with the full amount of adhesion as is the portion of the tape 12 below the slit. Therefore, as depicted in FIG. 10 a layer of deadening material 25 is applied to the tape just beneath the tear strip portion 30 and in other areas of the tape as shown in FIG. 19 which illustrates the tape segment of this embodiment. The graduated printing of deadening material provides the different areas of adhesion which permit the reclosable opening of the package and a dry grip edge. Once the tear away portion of the tape has been removed as shown in FIG. 11, the resulting package may be opened as shown in FIG. 12 with the width of the dry edge reduced by the width of the tear away strip.

Yet another feature of the invention is shown in FIGS. 13-17 which may be applied to either of the two previous embodiments but is shown here as applied to the embodiment depicted in FIGS. 1-7. In this embodiment, the upper heat seal 40 has been extended to reach downward over the reclosable tape to a longitudinal point at the top edge 13*a* of the slit 13. All other aspects of the packaging remain the same. Because of the nature of the tape film which can have an adhesive on the package side and a release coating on its outer side, the tape does not become welded to the packaging film but otherwise retains its same degree of adhesion as in the previous embodiments and therefore its operation is not affected by the heat seal. Extending the area of the heat seal downward to the top edge of the slit has several advantages. First, the rippled nature of the heat seal jaws provide the packaging film with an irregular rippled surface that provides a more tactile and more easily grasped top edge of the sealing tape. Secondly, as shown in FIGS. 15 and 16 a pocket in the packaging that would otherwise be formed above the slit as shown in FIG. 11 (at 31) is eliminated. It may be desirable to eliminate the pocket shown in FIG. 11 because the pocket can interfere with gravity dispensing of the contents of the bag when it is inverted.

Referring now to FIGS. 17-22, in each of this group of figures showing individual tape segments, the location of the slit beneath the tape is indicated by the dashed lines. The amount of stippling indicates the degree of adhesion. In the white areas which are devoid of stippling, the greatest amount of deadening material has been overprinted onto the tape segment in that area; where there is moderate stippling, a moderate degree of deadening material has been overprinted onto the tape segment; and where the stippling is the heaviest no deadening material has been applied so that the relative adhesion is the greatest. The deadened areas are printed on said tape web in a repeat pattern wherein cuts made along the lines between successive patterns produce substantially identical tape segments.

Figure 18:
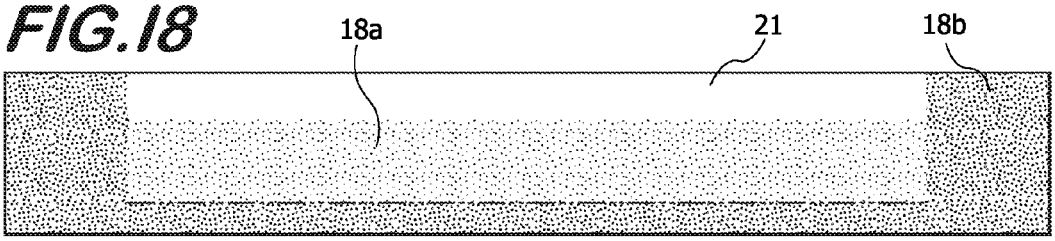
FIG. 18 is a front elevation plan view of the resealing strip after deadening material is applied with stippling indicating the degree of adhesiveness.

FIG. 18 corresponds to the embodiment shown in FIGS. 1-7 and depicts three areas of differential adhesion. The topmost area of least adhesion corresponds to the "dry" grip area 21 in that embodiment. The area of moderate adhesion 18*a* corresponds to that area of the tape below the grip edge but above the slit. The area of greatest adhesion 18*b* is that portion of the tape wrapped around the rear of the package and located below the slit. Therefore, as the tape is pulled forwardly as shown in FIG. 6, the moderately adhesive area of the tape releases from the top portion of the front panel to allow the slit to open but the tape will not release from the bottom portion of the front panel below the slit.

FIG. 19 corresponds to the tear strip embodiment shown in FIGS. 8-12. Here the tear off portion 30 of the tape is provided with the least amount of adhesion at its lateral sides 30*a* and 30*b* but the greatest amount of adhesion elsewhere. Thus, because the separation strength between this portion of the tape is greater than the tear strength of the perforation 32 the top portion 30 of the tape strip will tear away across the perforation when pulled laterally across the face of the package as shown in FIG. 9. As in FIG. 18, this strip is otherwise provided with the greatest amount of adhesion along the sides and at the bottom for the purposes previously described.

FIGS. 20-23 illustrate alternate configurations of tape shape, slit shape and location of areas of differential adhesion achieved by overprinting different amounts of deadening material onto the tape adhesive. Differing densities of deadening material can be applied by graduated screen printing in any shape desired. These embodiments also demonstrate that through the use of programmed laser cutting, the tapes may have curvilinear top and bottom edges and the slit may also be straight or curved. Each different combination of elements will provide differing opening characteristics, the possibility of shapes and relative dimensions being endless.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A package comprising:

a front panel having a top portion and a bottom portion divided by an elongate lateral slit;

an adhesively coated sealing tape segment cut from a supply roll and applied directly to the surface of said front panel bridging the slit and being of such dimension to fully surround the slit and wrap around side edges of the package for adhesion to a rear panel of said package;

wherein said adhesive tape segment includes a non-adhesive area along a lateral top edge thereof lying against the front panel but not against the rear panel to allow the manual pulling forward of the tape away from the top portion of said panel above said slit while ends of the tape segment remain fully secured to the rear panel; and a tear away portion along the lateral top edge, said tear away portion including an adhesive area of said tape segment adhered to the front panel, wherein sides of the tear away portion are defined by opposite facing L-shaped slits in the tape.

2. The package of claim 1 wherein the adhesive coating is coextensive with said tape segment and said non-adhesive area is provided by an overcoating of adhesion-deadening material or a strip of suitable plastic film.

3. The package of claim 2 wherein a lower lateral marginal edge of said tear away portion includes a line of perforations through said tape.

4. The package of claim 3 wherein separation strength of said tear away portion to said package is greater than the tear resistance of said perforations.

5. The package of claim 1 wherein lateral side end portions of said tear away portion have deadening material overcoating their adhesive layer.

6. The package of claim 5 wherein said lateral side end portions are non-adhesive.

7. The package of claim 1 wherein varying densities of a deadening material are deposited by screen printing over said adhesive layer to produce areas of said tape segment differing in adhesion from a degree of greatest adhesion to a degree of non-adhesion.

8. The package of claim 7 wherein said tape segment includes selected areas of lesser deadening material density adjacent other adhesive areas to provide moderate relative adhesion between said tape and said film compared to said other areas which have greater and lesser adhesion.

9. The package of claim 8 wherein an area of greatest adhesion lies along an entire lower edge of the tape segment.

10. The package of claim 9 wherein an area of moderate adhesion of said tape segment lies between said area of greatest adhesion and said non-adhesive area.

11. The package of claim 10 wherein said slit lies along a line between said area of moderate adhesion and said area of greatest adhesion.

12. The package of claim 1 wherein said slit extends a full width of said package.

13. The package of claim 1 wherein said tear away portion of said tape extends a full width of said package.

14. The package of claim 1 wherein longitudinal edges of the tape segment are curved.

15. The package of claim 1 wherein said slit is curved.

16. The package of claim 1 wherein said non-adhesive area along the lateral top edge of said tape segment is provided by a strip of plastic film applied to the adhesive layer.

17. A package comprising:

a front panel having a top portion and a bottom portion divided by an elongate lateral slit;

an adhesively coated sealing tape segment cut from a supply roll and applied directly to the surface of said front panel bridging the slit and being of such dimension to fully surround the slit and wrap around side edges of the package for adhesion to a rear panel of said package;

wherein said adhesive tape segment includes a non-adhesive area along a lateral top edge thereof lying against the front panel but not against the rear panel to allow the manual pulling forward of the tape away from the top portion of said panel above said slit while ends of the tape segment remain fully secured to the rear panel; and laterally extending top and bottom heat seal welds, wherein one of said top and bottom heat seal welds extends over said tape longitudinally down to the location of the slit forming an irregular rippled surface of the tape segment.

18. A package comprising:

a front panel having a top portion and a bottom portion divided by an elongate lateral slit;

an adhesively coated sealing tape segment applied to the surface of said front panel bridging the slit and being of such dimension to fully surround the slit and wrap around side edges of the package for adhesion to a rear panel of said package;

wherein said adhesive tape segment includes a non-adhesive area along a lateral top edge thereof lying against the front panel but not against the rear panel to allow the manual pulling forward of the tape away from the top portion of said panel above said slit while ends of the tape segment remain fully secured to the rear panel;

wherein varying densities of a deadening material are deposited by screen printing over said adhesive layer to produce at least three areas of said tape segment differing in adhesion from a degree of greatest adhesion to a degree of non-adhesion; and a tear away portion along the lateral top edge, said tear away portion including an adhesive area of said tape segment adhered to the front panel, wherein sides of the tear away portion are defined by opposite facing L-shaped slits in the tape.

* * * * *